United States Patent [19]

Lowe

[11] 4,321,131

[45] Mar. 23, 1982

[54] PROCESS FOR HEAT CARRIER GENERATION

[75] Inventor: Christopher M. Lowe, Saint Albans, W. Va.

[73] Assignee: Union Carbide Corporation, New York, N.Y.

[21] Appl. No.: 254,506

[22] Filed: Apr. 15, 1980

[51] Int. Cl.[3] ..... C07C 2/10; C07C 4/02; C07C 4/04; C10G 9/36

[52] U.S. Cl. ..... 208/130; 585/648; 585/539

[58] Field of Search ..... 208/130; 585/648, 652, 585/650, 539

[56] References Cited

U.S. PATENT DOCUMENTS

| | | | |
|---|---|---|---|
| 2,790,838 | 4/1957 | Schrader | 585/539 |
| 3,019,271 | 1/1962 | Branconier et al. | 585/539 |
| 3,178,488 | 4/1965 | Akin | 585/539 |
| 3,692,862 | 9/1972 | Staud et al. | 585/539 |
| 4,134,824 | 1/1979 | Kamm et al. | 585/652 |
| 4,156,015 | 1/1979 | Kamm et al. | 585/648 |

FOREIGN PATENT DOCUMENTS

| | | | |
|---|---|---|---|
| 670240 | 9/1963 | Canada | 585/539 |
| 945448 | 1/1964 | United Kingdom | 585/652 |

OTHER PUBLICATIONS

"Ethylene from Crude Oil" in vol. 71, No. 11, Nov. 1975, pp. 63–67, *Chemical Engineering Progress.*

*Primary Examiner*—Delbert E. Gantz
*Assistant Examiner*—Helane E. Maull
*Attorney, Agent, or Firm*—Gerald R. O'Brien, Jr.

[57] ABSTRACT

A process is disclosed for heat carrier generation for the advanced cracking reaction process comprising separately preheating an oxidant stream; joining a fuel stream and at least a portion of the process steam stream to form a stream having a steam-to-fuel ration between 0.1–10; preheating the joined stream; reforming said joined stream at a temperature up to 1000° C. in the presence of a reforming catalyst comprising at least one metal selected from the metals of Group VIII of the Periodic Table of Elements on an inert support; separately preheating any remainder of the process steam; and mixing said preheated oxidant, joint and steam streams to burn in admixture in a combustion zone to provide a hot gaseous combustion products stream.

12 Claims, 2 Drawing Figures

PROCESS FOR HEAT CARRIER GENERATION

Figure 1:
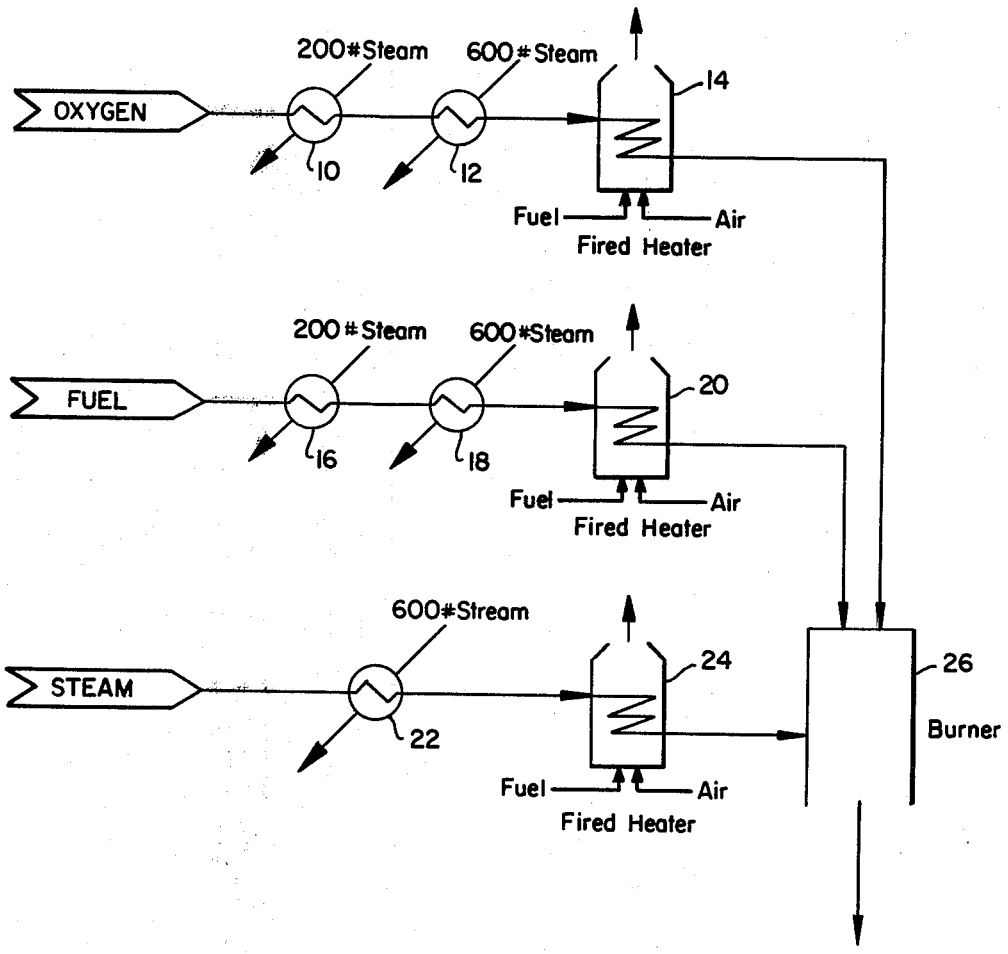

The present invention relates to a process for heat carrier generation for an advanced cracking reaction process.

As employed herein, the term "advanced cracking reaction (ACR) process" means a process in which a stream of hot gaseous combustion products may be developed by the burning in a combustion zone of any of a wide variety of fluid fuels (e.g. gaseous, liquid and fluidized solids) in an oxidant and in the presence of superheated steam. The hydrocarbon feedstock to be cracked is then injected and mixed into the hot gaseous combustion product stream to effect the cracking reaction in a reaction zone. Upon quenching in a final zone, the combustion and reaction products are then separated from the stream.

The operation of the ACR process is more fully disclosed in an article by Hosoi et al entitled "Ethylene from Crude Oil" in Vol. 71, No. 11, November 1975, pp. 63–67 *Chemical Engineering Progress.* One mode of operation of such a process is disclosed and claimed in U.S. Pat. No. 4,136,015 issued Jan. 23, 1979 to G. R. Kamm et al, and entitled "Process for Thermal Cracking of Hydrocarbons."

In the ACR process, wherein thermal cracking of a hydrocarbon feedstock is effected by direct contact with a gaseous heat carrier and wherein the gaseous heat carrier is produced by the combustion of a fuel with oxygen (with or without steam addition) in a burner, it is advantageous to minimize the amount of fuel and oxygen required to produce a heat carrier gas of a certain flow and temperature, and to minimize the carbon monoxide and carbon dioxide content of this heat carrier gas, thereby reducing the difficulty of downstream separations. This is also advantageous from the point of view that the combustion zone fuel is preferentially of high quality, containing no sulfur or other contaminants which would add to downstream separations problems. A fuel of this quality is in large demand, costly and difficult to obtain. By reducing the amount of combustion zone fuel, it is possible to supply the combustion requirement with by-product fuel production from the cracking reaction, thus removing the need for external purchase of such a high quality fuel.

Currently, combustion zone fuel and oxygen requirements are minimized by individual preheat of fuel, oxygen, and steam through the use of less costly energy sources, such as heat exchange with steam and fluid fuel combustion with air in a fired heater. The preheat of fuel is limited by the temperature at which coking-/fouling/carbon laydown occurs, thereby causing operability problems. The preheat of oxygen and steam is limited by economically practical materials of construction. After preheat, the fuel is combusted with oxygen in a burner with steam addition to produce a high temperature gaseous stream suitable for supplying heat and dilution for the cracking reaction.

In accordance with the present invention an advanced cracking reaction process is provided, wherein a stream of hot gaseous combustion products is developed in a first stage combustion zone by the burning of a fluid fuel stream in an oxidant stream and in the presence of steam stream, and hydrocarbon feedstock to be cracked is injected and mixed, in a second stage reaction zone, into the hot gaseous combustion products stream to effect the cracking reaction, and wherein each of the oxidant, fuel and steam streams are preheated prior to admixture and combustion, the improvement which comprises: separately preheating said oxidant stream; joining said fuel stream and at least a portion of said steam stream to form a joined stream having a steam-to-fuel ratio between 0.1–10 and preheating and reforming said joined stream at a temperature up to 1000° C. in the presence of a reforming catalyst comprising at least one metal selected from the metals of Group VIII of the Periodic Table of Elements on an inert support capable of imparting structural strength; separately preheating any remainder of the process steam stream; and mixing said preheated oxidant, joint and remainder steam streams to burn in admixture in said first stage combustion zone to provide said hot gaseous combustion products stream.

By premixing of the fuel with a portion of the steam, it is possible to increase the limit of fuel preheat without the problem of coking/fouling/carbon laydown in the preheater. By passing this premixed fuel and steam over an appropriate reforming catalyst, such as nickel supported on alumina, with energy input to supply heat for the endothermic reforming reaction, the total energy of the burner feeds are increased by the use of less costly, more abundant energy sources. Upon combustion in the burner (first stage combustion zone), less fuel and oxygen are required to produce a similar/equivalent heat carrier gas, containing less carbon monoxide and carbon dioxide than would be present by individual preheat of fuel oxygen and steam alone.

The reforming catalyst employed in the reforming zone of the present invention may comprise any metallic catalyst of Group VIII of the Periodic Table of Elements, (i.e., Fe, Co, Ni, Ru, Rh, Pd, Os, Ir, Pt), or any combination thereof. Nickel is the preferred catalyst.

The catalyst is supported on an appropriate known inert refractory metal oxide, such as alumina, magnesia, calcium aluminate, calcium oxide, silica and/or other support materials, either alone or in combination. The support imparts structural strength and stability to the catalyst which may then be coated thereupon as an oxide or other compound of the metallic element(s) and reduced or otherwise converted in situ to the metallic state.

In the case where the fuel contains carbon monoxide in the absence of carbon dioxide, carbon formation is possible by the well known reaction:

$$2\,CO \rightleftharpoons C + CO_2$$

In this case, it is preferable to treat the fuel so that carbon dioxide is present in proper concentration with respect to carbon monoxide. This is possible by (a) direct addition of carbon dioxide; (b) by passing the fuel over an appropriate methanation catalyst with hydrogen to form methane and water; (c) by passing the fuel with steam over an appropriate shift catalyst to form carbon dioxide and hydrogen; or (d) by combusting a small part of the fuel and oxygen with steam addition in an external burner to supply carbon dioxide to the reformer inlet. These treatment steps, and apparatus and catalysts therefor, are well known per se to those skilled in the chemical processing art.

It has been found that the following constitute the specific steps of the process of this invention:

Oxygen Preheating

The purity of the oxygen (oxidant) stream employed may be between 21 mole % (air) and 100 mole %; the pressure between 1 and 100 atmospheres; preheated to any desired degree up to 1000° C. in fired heater.

It is preferable to employ oxygen at a purity of 99+ mole % at ambient temperatures and at between 5 and 12 atmospheres, preheated to between 500° C. and 800° C.

Fuel and Steam Stream Joining

A fuel, containing typical hydrocarbon, hydrogen and carbon oxides, at a pressure between 1 atmosphere and 100 atmospheres, is mixed with steam at between 1 atmosphere and 100 atmospheres, with any desired degree of preheat up to 1000° C.; and at a steam-to-fuel ratio (wt.) of between 0.1 to 10.

It is preferred that a gaseous fuel, containing hydrogen and methane at ambient temperature and between 5 to 12 atmospheres, is mixed with saturated steam at between 5 to 12 atmospheres at a steam-to-fuel ratio (wt.) of between 1 and 5.

Preheating of Fuel/Steam Joined Stream

This fuel/steam mixture is preheated to any desired degree up to 1000° C., preferably to between 700° C. and 900° C., before entering reforming furnace.

Remaining Steam Preheating

Remaining steam is preheated to any desired degree up to 1000° C., preferably to between 800° C. and 1000° C., in a fired heater.

Reforming of Fuel/Steam Joined Stream

The fuel/steam mixture is reformed at any desired degree up to 1000° C., preferably at between 800° C. and 1000° C. in a reforming furnace.

Reformed fuel/steam mixture (joined stream) is combusted in the burner with oxygen at between 75% to 125% of the oxygen required for complete combustion with steam. The mixture is added in the burner at a rate of up to 25 lb. steam per pound of fuel and oxygen to produce a gaseous heat carrier having a high temperature.

Figure 2:
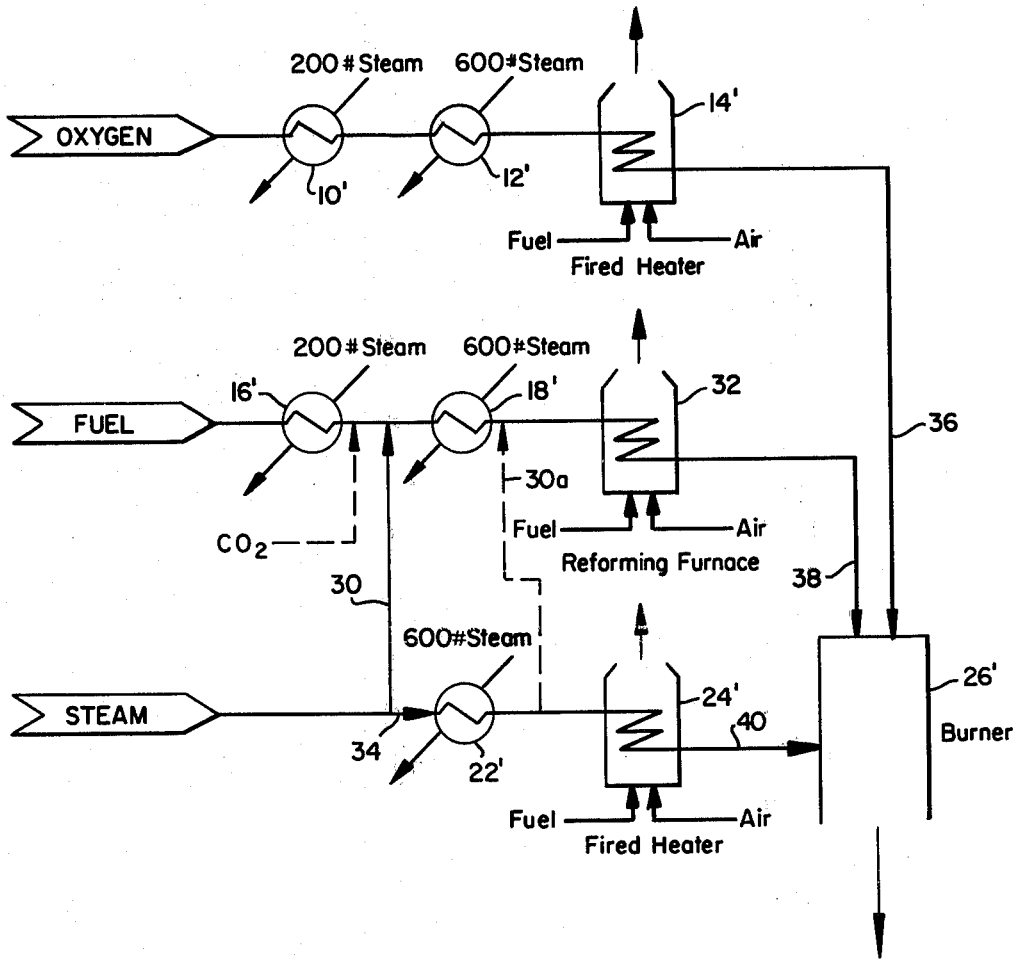

In the drawings:

FIG. 1 apparatus is a schematic representation of the prior art, currently employed for the preheating of oxygen, fuel and steam in an environment as defined by the ACR process; and FIG. 2 is a schematic representative of apparatus suitable for employment in the practice of the improved process of the invention, for the preheating of oxygen, fuel and steam in an environment as defined by the ACR process.

As shown schematically in FIG. 1 of the drawing, oxygen or other oxidant, normally encountered at a temperature of 21° C. and supplied at 150 lb. pressure is preheated in a succession of two preheaters 10 and 12. In the first preheater 10, which is of the shell-and-tube type heat exchanger, the oxidant stream is heated with 200 lb. steam having a temperature of approximately 200° C. In the second heat exchanger 12 the oxidant is further heated with 600 lb. steam to a temperature of the order of 240° C. prior to heater 14 which is a tube furnace heated by the combustion of fuel and air. The saturated steam at 600 lb. is of the order of 255° C. in temperature. The oxidant stream from fired heater 14 is of the order of 600° C. which represents the highest preferable temperature boundary of the process of the invention, due to metallurgical limitations of the system. Concurrently, fuel (preferably sulfur-free) in gaseous form is supplied, at ambient temperature 21° C., at pressure of the order of 100–150 lb. to line heat exchanger 16, which is heated with 200 lb. steam.

The fuel stream is, successively, passed to fuel line preheater 18, which is of the shell-and-tube type and which elevates the fuel stream to a temperature of the order of 240° C. The fuel stream is injected into a fired heater 20 for further preheating and discharges at a temperature of approximately 600° C., which is an effective temperature limitation of preheating for the fuel stream, since heating to higher temperature causes the deposition of carbon.

Concurrently therewith, 125 lb. steam (177° C.) is introduced through line shell-and-tube heat exchanger 22 and is heated in exchange with 600 lb. steam and elevated to a temperature of 240° C. prior to introduction into a fired heater 24, which is discharged at approximately 800° C., which represents substantially the ultimate temperature limitations in the steam in the process of the present invention due to metallurgical limitation such as the loss of strength of materials of construction.

All three streams of preheated oxygen, fuel and steam are concurrently introduced into burner 26, where they are combusted to provide the heat carrier fluid stream employed in the ACR cracking process.

This prior art preheating process has been improved by the process of the present invention which is shown schematically in FIG. 2 of the drawing.

As there shown, equivalent apparatus entities have been assigned the same reference numerals as applied in FIG. 1 and have been primed. Accordingly, similar heating takes place in the oxygen lines elements 10', 12' and 14'. The fuel is preheated in heat exchanger 16' prior to joinder of a portion of the steam (or theoretically all of the steam) from the steam line with the fuel line through line 30, prior to preheating in a larger heat exchanger 18' which is heated by 600 lb. steam. The preheated fuel and steam stream mixture is introduced into a reforming furnace 32.

It is alternatively equal in operability and preferability to introduce fully (600 lb. preheated steam into admixture with fully (600 lb.) fuel stream, as shown by dotted line **30*a* in FIG. 2 of the drawings. It is believed that substantially equal process results will be obtained as for the introduction of steam-to-fuel through the line 30** mode. Similarly alternate mixing of fuel and steam at different preheat levels would be substantially equivalent in result.

The remaining portion of the steam stream is passed through line 34 to heat exchanger 22', heat interchanged with 600 lb. steam prior to feeding to fired heater 24'.

The concurrent feeding of the preheated oxygen stream, reformed joined fuel and steam streams, and the remainder steam stream, is carried out through lines 36, 38 and 40 respectively to burner 26' where they are mixed and combusted to form the heat carrier combustion production steam for the ACR process.

Control Experiment A: Current Practice

A gaseous heat carrier is produced at 2180° C., 5.76 atmospheres and at a rate of 7.7 lb. moles per 100 lb. of hydrocarbon feedstock to be cracked. Oxygen is preheated to 600° C.; methane fuel is preheated to 600° C.;

and saturated steam is preheated at 8.8 atm to 800° C. The preheated methane fuel is combusted in a burner with preheated oxygen at 5% excess fuel over the stoichiometric balance, with steam addition, with 99.5% oxygen combustion efficiency and with 1½% of heat release being heat losses. This operation requires 78,899 Btu's energy for preheat; 12.98 lb. of fuel; 49.55 lb. of oxygen; and 94.89 lbs. of steam, all such measures (hereinabove and below) having been determined on the basis of 100 lb. of hydrocarbon feedstock to be cracked.

The heat carrier produced will contain 0.2 lb. hydrogen; 1.04 lb. carbon monoxide; 33.97 lb. carbon dioxide; 121.91 lb. steam; and 0.24 lb. oxygen.

Example 1: Reforming

The same relationship are maintained as in Control Experiment A, except that the methane fuel is mixed with 3 parts by weight steam and is reformed at 800° C., 6.4 atmospheres, assuming a 25° C. approach to equilibrium. This operation requires 83,503 Btu's preheat; 50,170 Btu's heat of reaction; 10.19 lb. fuel; 38,88 lb. oxygen; and 103.31 lb. steam.

The heat carrier produced will contain 0.20 lb. hydrogen; 0.66 lb. carbon monoxide; 26.90 lb. carbon dioxide; 125.43 lb. steam; and 0.19 lb. oxygen.

Example 1 shows that for less fuel and oxygen the practice of the process of the invention permits the introduction of more energy into the system.

Control Experiment B: Commercial (concentration) level (current practice)

The same relationships are maintained as in Control Experiment A, except that the fuel is 1.34 wt.% hydrogen, 79.61 wt.% methane, 1.02 wt.% ethylene and 18.03 wt.% carbon monoxide. This operation requires 79,268 Btu's preheat; 14.84 lb. fuel; 48.60 lb. oxygen; and 94.89 lb. steam.

The heat carrier produced will contain 0.23 lb. hydrogen; 1.05 lb. carbon monoxide; 33.45 lb. carbon dioxide; 121.36 lb. steam; and 0.24 lb. oxygen.

Example 2: Reforming plus $CO_2$ addition

The same relationships are maintained as in Control Experiment B, except that the fuel is mixed with 10% more carbon dioxide than theoretically required to prevent carbon formation by the reaction $2\ CO \rightleftharpoons CO_2 + C$ at 750° C. and 7.7 atmosphere. This mixture is further mixed with 3 parts by weight steam and reformed at 800° C. and 6.4 atmosphere assuming a 25° C. approach to equilibrium. The operation requires 83,949 Btu's preheat; 47,468 Btu's reaction heat input; 11.80 lb. fuel; 0.25 carbon dioxide; 38.63 lb. oxygen; and 103.77 lb. steam.

The heat carrier produced will contain 0.19 lb. hydrogen; 0.70 lb. carbon monoxide; 28.64 lb. carbon dioxide; 124.73 lb. steam; and 0.19 lb. oxygen.

What is claimed is:

1. In an advanced cracking reaction process, wherein a stream of hot gaseous combustion products is developed in a first stage combustion zone by the burning of a fluid fuel in an oxidant and in the presence of steam, and hydrocarbon feedstock to be cracked is injected and mixed, in a second stage reaction zone, into the hot gaseous combustion products stream to effect the cracking reaction, and wherein each of the oxidant, fuel and steam process streams are preheated prior to admixture and combustion, the improvement which comprises: separately preheating said oxygen stream; joining said fuel stream and at least a portion of said steam process stream to form a stream having a steam-to-fuel ratio between 0.1–10 and preheating the joined stream; reforming said joined stream at a temperature up to about 1000° C. in the presence of a reforming catalyst comprising at least one metal selected from the metals of Group VIII of the Periodic Table of Elements on an inert support capable of imparting structural strength; separately preheating any remainder of the process steam; and mixing said preheated oxidant, joint and remainder steam process streams to burn in admixture in said first stage combustion zone to provide said hot gaseous combustion products stream.

2. The process in accordance with claim 1, wherein said oxidant stream has an oxygen content of between 21 and 100 mole percent, an initial temperature between ambient and 1000° C., a pressure between one atmosphere and 100 atmospheres and a temperature after preheating up to about 1000° C.

3. The process in accordance with claim 2, wherein the oxidant contains oxygen having a purity in excess of 99 mole percent at ambient temperatures, pressure between about 5 and 12 atmospheres and a preheated temperature between about 500° C. and 800° C.

4. The process in accordance with claim 1, wherein the fluid fuel stream, having a temperature between about ambient and about 1000° C. and a pressure between about one atmosphere and 100 atmospheres, mixed with superheated steam at between about one atmosphere and 100 atmospheres to provide a joined stream having a steam-to-fuel ratio of between about 1.0 and 5.

5. The process in accordance with claim 1 wherein the joined fuel and steam stream is preheated to a temperature between about 700° and 900° C.

6. The process in accordance with claim 1, wherein said remainder of the process steam is preheated to a temperature between 500° C. and 1000° C., preferably between 800° C. and 1000° C.

7. The process in accordance with claim 1, wherein the joined stream of fuel and steam is reformed at a temperature between about 800° C. and 1000° C.

8. The process in accordance with claim 1, wherein said fuel stream is mixed, prior to the mixing of the fuel and steam streams, with of the order of about 10% more carbon dioxide than theoretically required to prevent carbon formation at the operating temperature and pressure.

9. The process in accordance with claim 1, wherein the reformed joined stream of fuel and steam is combusted in said combustion zone with oxidant stream at between about 75 percent to 125 percent of the oxygen required for complete combustion with steam added to the combustion zone at a rate up to 25 pounds of steam per pound of fuel and oxygen.

10. The process in accordance with claim 1 wherein said reformer catalyst is nickel supported on alumina.

11. The process in accordance with claim 1 wherein said inert support system comprises at least one refractory metal oxide.

12. The process in accordance with claim 11, wherein said inert refractory metal oxide is selected from the group consisting of alumina and silica.

* * * * *

UNITED STATES PATENT AND TRADEMARK OFFICE

CERTIFICATE OF CORRECTION

PATENT NO. : 4,321,131

DATED : March 23, 1982

INVENTOR(S) : C. M. Lowe

It is certified that error appears in the above—identified patent and that said Letters Patent is hereby corrected as shown below:

On The Title Page,

Change the Filing Date at [22] of the title page from "April 15, 1980" to --April 15, 1981--.

Signed and Sealed this

*Seventeenth* Day of *August 1982*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4321131

DATED : March 23, 1982

INVENTOR(S) : C. M. Lowe

It is certified that error appears in the above—identified patent and that said Letters Patent is hereby corrected as shown below:

In the abstract on the 5th line, the word "ration" should read "ratio".

Signed and Sealed this

*First* Day of *February 1983*

[SEAL]

*Attest:*

GERALD J. MOSSINGHOFF

*Attesting Officer*

*Commissioner of Patents and Trademarks*